US008019263B2

(12) United States Patent
Suzuki et al.

(10) Patent No.: US 8,019,263 B2
(45) Date of Patent: Sep. 13, 2011

(54) IMAGE FORMING APPARATUS BELT HAVING A DETECTING PORTION FOR POSITION DETECTION

(75) Inventors: Tomoko Suzuki, Kanagawa (JP); Yousuke Tsutsumi, Kanagawa (JP); Masahiko Miyamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 83 days.

(21) Appl. No.: 12/252,796

(22) Filed: Oct. 16, 2008

(65) Prior Publication Data

US 2009/0245894 A1 Oct. 1, 2009

(30) Foreign Application Priority Data

Mar. 31, 2008 (JP) ..... 2008-093325

(51) Int. Cl.
*G03G 15/01* (2006.01)

(52) U.S. Cl. ..... 399/302; 399/301; 399/396

(58) Field of Classification Search ..... 399/302, 399/303, 308, 301, 396
See application file for complete search history.

(56) References Cited

U.S. PATENT DOCUMENTS

| | | | | |
|---|---|---|---|---|
| 7,228,095 | B2 * | 6/2007 | Kuroda | 399/302 |
| 7,424,255 | B2 * | 9/2008 | Sakai | 399/301 |
| 2005/0286930 | A1 | 12/2005 | Sawai et al. | |
| 2007/0166082 | A1 | 7/2007 | Byun | |

FOREIGN PATENT DOCUMENTS

| | | |
|---|---|---|
| CN | 101000481 A | 7/2007 |
| JP | A-11-015297 | 1/1999 |
| JP | A 2000-147950 | 5/2000 |
| JP | A-2005-215440 | 8/2005 |
| JP | A2006-011003 | 1/2006 |
| JP | A 2006-018182 | 1/2006 |

OTHER PUBLICATIONS

Mar. 2, 2010 Office Action issued in Japanese patent application No. 2008-093325 (with translation).
Aug. 12, 2010 Office Action issued in Chinese patent application No. 200810185871.X (with translation).

* cited by examiner

*Primary Examiner* — Hoang Ngo
(74) *Attorney, Agent, or Firm* — Oliff & Berridge, PLC

(57) ABSTRACT

An image forming apparatus belt includes a belt main body; a guiding member that is fixed to the belt main body along at least a side edge on one side of the belt main body; and a detected portion for position detection that is provided in a slit of the guiding member.

15 Claims, 6 Drawing Sheets

IMAGE FORMING APPARATUS BELT HAVING A DETECTING PORTION FOR POSITION DETECTION

CROSS-REFERENCE TO RELATED APPLICATIONS

This application is based on and claims priority under 35 USC 119 from Japanese Patent Application No. 2008-093325 filed on Mar. 31, 2008.

BACKGROUND

1. Technical Field

The present invention relates to an image forming apparatus belt, a belt stretching device, and an image forming apparatus.

2. Related Art

As an image forming apparatus using an electrophotography system, for example, there is a color image forming apparatus of an intermediate transferring system using an intermediate transferring belt. In this apparatus, the intermediate transferring belt is rotated while contacting a transferring portion of an image bearing body (e.g., a photosensitive drum) on which a toner image is borne by an electrophotography process, or the like, and this intermediate transferring belt is provided such that this belt is stretched on a plurality of belt supporting rollers. A plurality of toner images borne on the image bearing body are primarily transferred once such that these images are superposed on the same position of the intermediate transferring belt, and then the toner images transferred on the intermediate transferring belt are secondarily transferred at a time onto a paper. Then, the multicolor toner image being secondarily transferred onto the paper is fixed by a fixing device to form a color image.

In addition, as an image forming apparatus equipped with another belt, there is the so-called tandem type color image forming apparatus using a paper conveying belt that holds a paper and coveys the paper to pass through transferring portions of a plurality of image forming units. In this apparatus, a plurality of image forming units for forming a toner image in each color component individually are aligned, and then the paper conveying belt is stretched on a plurality of belt supporting rollers such that this belt is rotated while contacting transferring portions of respective image forming units. The paper being sucked and held by the paper conveying belt is conveyed to pass through the transferring portions of respective image forming units. Thus, respective toner images formed by the image forming units are transferred onto the same paper such that they are superposed sequentially, and then fixed finally to form the color image.

In the image forming apparatus equipped with such intermediate transferring belt or such paper conveying belt, the high-precision position control is indispensable in superposing the images precisely. In the related art, the position control of the belt is made by detecting a predetermined position of the belt by a sensor.

SUMMARY

According to an aspect of the invention, there is provided an image forming apparatus belt including: a belt main body; a guiding member that is fixed to the belt main body along at least a side edge on one side of the belt main body; and a detected portion for position detection that is provided in a slit of the guiding member.

BRIEF DESCRIPTION OF THE DRAWINGS

Exemplary embodiments of the present invention will be described in detail based on the following figures, wherein:

FIG. 6 is a schematic configurative view of an example of a tandem-type image forming apparatus that is equipped with the image forming apparatus belt of the present embodiment as an intermediate transferring belt, wherein

Figure 1:
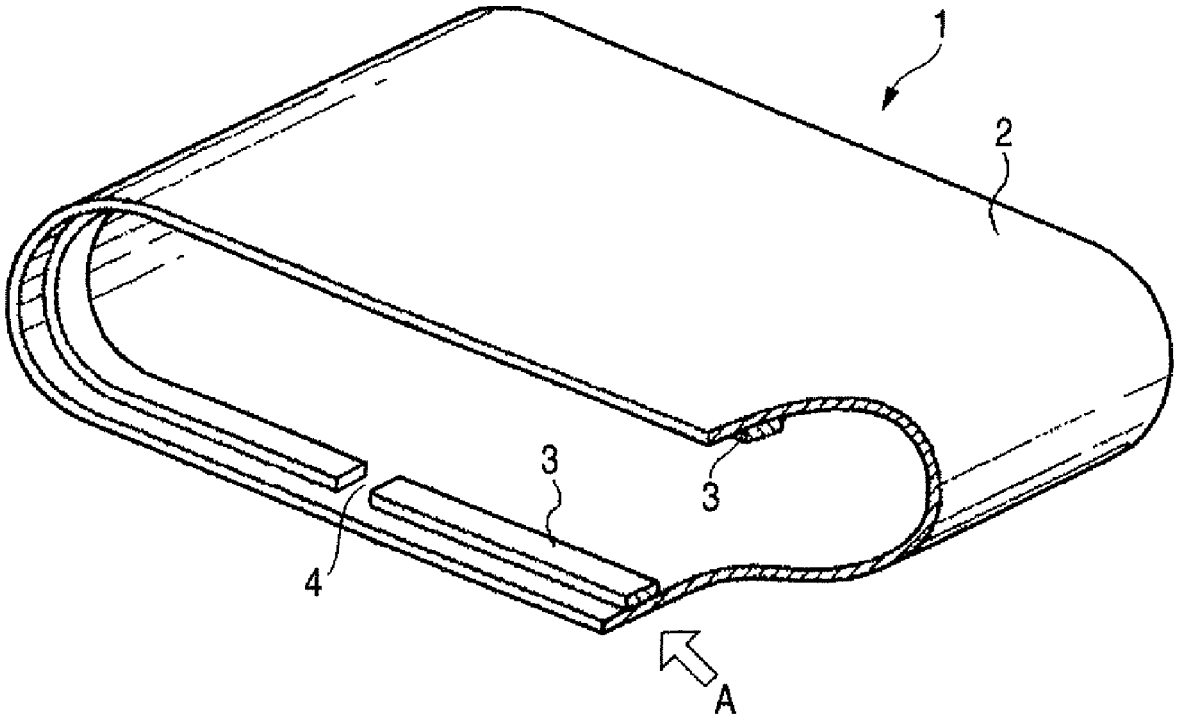
FIG. 1 is a perspective view showing an example of an image forming apparatus belt of a present embodiment.

1 and 10 each denotes an image forming apparatus belt,
2 and 12 each denotes a belt main body,
3, 13 and 15 each denotes a guiding member,
4 and 14 each denotes a slit,
17 denotes a detected portion,
30 denotes a detecting portion,
33 denotes a light emitting unit,
35 denotes a light receiving unit,
71 denotes a toner cartridge,
72 denotes a fixing roller,
73 denotes a backup roller,
74 denotes a tension roller,
75 denotes a secondary transferring roller,
76 denotes a paper conveying path,
77 denotes a paper tray,
78 denotes a laser generator (an exposure unit),
79 denotes a photosensitive body,
80 denotes a primary transferring roller,
81 denotes a driving roller,
82 denotes a transfer cleaner,
83 denotes a charging roller (a charging unit),
84 denotes a photosensitive body cleaner (a cleaning unit),
85 denotes a developer unit (a developing unit),
86 denotes an intermediate transferring belt,
101 denotes a photosensitive drum,
102 denotes an intermediate transferring belt,
103 denotes a bias roller,
104 denotes a tray,
105 denotes a BK (black) toner developing unit,
106 denotes a Y (yellow) toner developing unit,
107 denotes a M (magenta) toner developing unit,
108 denotes a C (cyan) toner developing unit,
109 denotes a belt cleaner,
113 denotes a separating claw,
121, 123 and 124 denote a belt supporting roller,
122 denotes a backup roller,
125 denotes a conductive roller,
126 denotes an electrode roller,
131 denotes a cleaning blade,
141 denotes a paper,
142 denotes a pickup roller,
143 denotes a field roller,

201Y, 201M, 201C and 201BK each denotes a photosensitive drum,

202Y, 202M, 202C and 202BK each denotes a charging roller,

203Y, 203M, 203C and 203BK each denotes an exposure unit,

204Y, 204M, 204C and 204BK each denotes a developing unit,

205Y, 205M, 205C and 205BK each denotes a photosensitive drum cleaner,

206 denotes a paper conveying belt,

207Y, 207M, 207C and 207BK each denotes a transferring roller,

208 denotes a paper conveying roller,

209 denotes a fixing unit,

210, 211, 212 and 213 each represents a belt supporting roller,

214 denotes a belt cleaning unit, and

216 denotes a paper (transferred body).

DETAILED DESCRIPTION

An image forming apparatus belt of an embodiment of the present invention is characterized in including a belt main body, a guiding member adhered onto the belt main body along at least a side edge on one side of the belt main body, and a detected portion for position detection provided in a slit of the guiding member.

The image forming apparatus belt of the present embodiment will be explained hereinafter.

(Image Forming Apparatus Belt)

The image forming apparatus belt (simply referred to as a "belt" hereinafter) of the present embodiment is not particularly limited if a loop-shaped endless belt for use in image formation may be employed. Also, the belt used in any purpose out of exposing step, intermediate transferring step, transferring/separating step, paper conveying step, charging step, fixing step, developing step, and the like may be called this belt. This belt can be used particularly preferably as the intermediate transferring belt or the paper conveying belt, of which a high positional precision is required, out of these purposes.

The image forming apparatus belt of the present embodiment will be explained with reference to the drawings hereinafter.

Figure 2A:
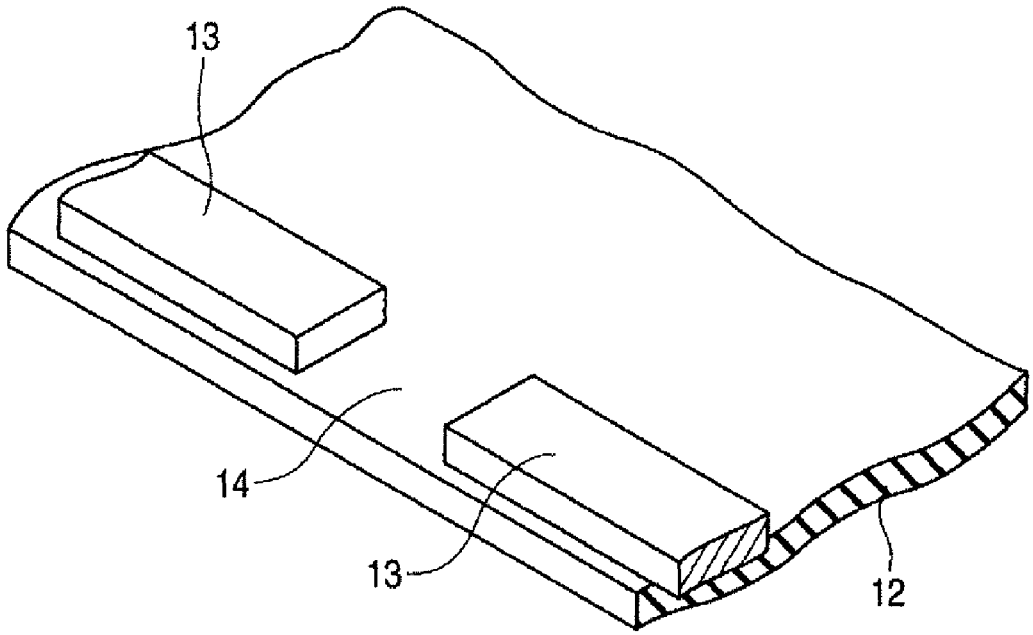
FIGS. 2A and 2B are fragmental enlarged perspective views of the image forming apparatus belt when viewed from the direction indicated with an arrow A in FIG. 1.
Figure 2B:
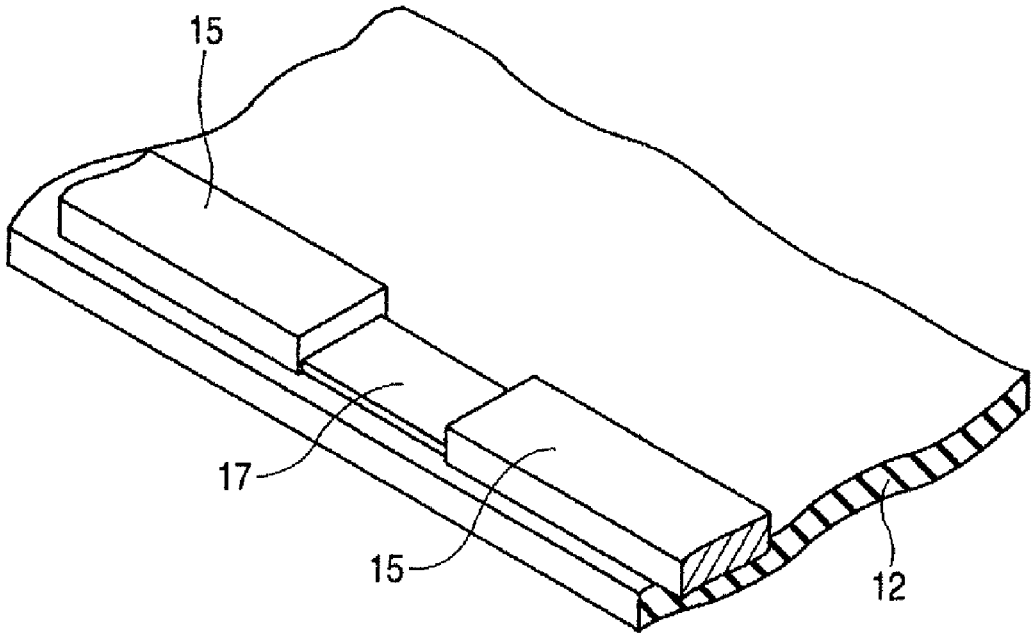
Figure 3:
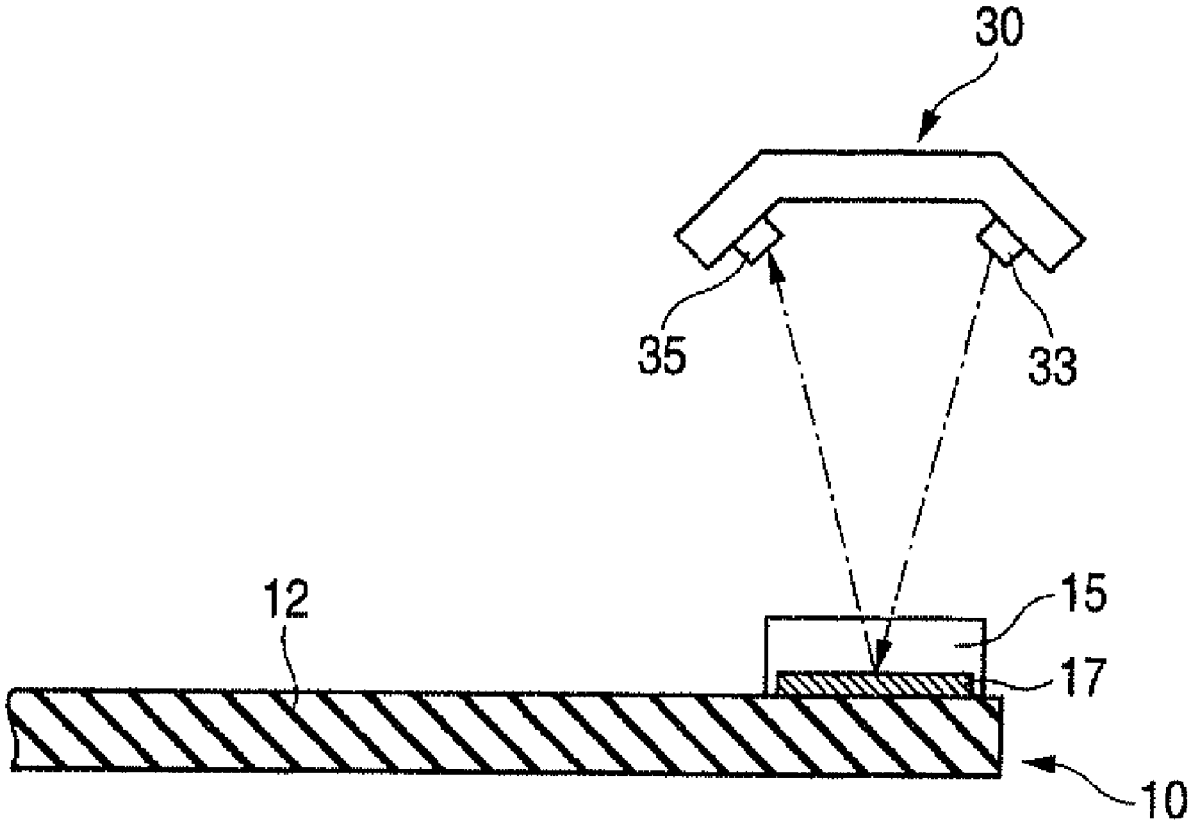
FIG. 3 is a conceptual sectional view of an example in which a detected portion provided to a belt is detected optically.

FIG. 1 is a perspective view showing an example of the image forming apparatus belt of the present embodiment, a part of which is illustrated as a cross-section. FIGS. 2A and 2B are fragmental enlarged perspective views of the image forming apparatus belt when viewed from the direction indicated with an arrow A in FIG. 1, and shows details of a detected portion. FIG. 3 is a conceptual sectional view of an example in which a detected portion provided to the image forming apparatus belt is optically detected.

In FIG. 1, an image forming apparatus belt 1 has an endless belt main body 2, and a guiding member 3 fixed to the belt main body along a side edge on one side of the belt main body 2. At least one slit 4 is provided to the guiding member 3. This slit 4 itself may be used as the detected portion for position detection, or a member used as the detected portion may be provided in this slit.

Out of an outer peripheral surface (outside surface) of the belt main body, a center area in the width direction is used in forming the image. Respective areas of the belt main body on side edges correspond to the areas that are positioned on both sides of the outer peripheral surface of the belt main body in the width direction and not used in forming the image, and the areas of an opposing inner peripheral surface (inside surface). The guiding member is fixed to this area to prevent a wobbling motion of the belt main body.

The guiding member may be provided to either of the outside surface and the inside surface of the belt main body. As shown in FIG. 1, it is preferable that the guiding member 3 should be provided to the inside surface of the belt main body 2. But the guiding member 3 may be provided to the outside surface of the belt main body 2 depending upon the application use of the belt 1. Also, the guiding member is fixed on one side or both sides of the belt main body in the width direction to extend in the circumferential direction. It is preferable that the guiding member 3 should be provided along the end portion of the belt main body 2 in the width direction.

It is preferable that the guiding member 3 should be fixed to the belt main body 2 via the adhering portion. But the guiding member may be fixed directly without intervention of the adhering portion.

In order to detect a rotation position of the belt main body 2 in the circumferential direction, at least one detected portion for position detection (simply referred to as a "detected portion" hereinafter) is provided on the slit 4 of the guiding member 3. A concrete mode will be explained hereunder.

<Guiding Member and Slit>

A shape of the guiding member will be explained hereunder with reference to the case where the belt main body has an image area in which an image of an A3 size is reproduced. A width of the guiding member is not particularly limited. But preferably a width of 1 to 10 mm, more preferably 4 to 7 mm, should be used from viewpoints of a wobbling motion preventing effect, durability, and the like. Also, a thickness of the guiding member is not particularly limited. But preferably a thickness of 0.5 to 5 mm, more preferably 1 to 2 mm, should be used from viewpoints of the wobbling motion preventing effect, durability, and the like. The guiding member is provided over the full length of the belt main body in the circumferential direction except the slit area.

In the image forming apparatus belt of the present embodiment, the guiding member 3 has at least one slit 4. This slit 4 is formed as a clearance between opposing end surfaces of the guiding member 3. It is preferable that the end surfaces of the guiding member 3 are formed vertically to the length direction. One slit or more may be provided in the circumferential direction, and a plurality of slits may be provided. But it is preferable that ones lit should be provided. Also, it is preferable that, when two slits or more are provided to the guiding member, these slits should be provided at an equal interval.

A size of the slit can be chosen appropriately to meet a size of the belt. For example, when the belt main body has an image area in which an image of an A3 size is reproduced, preferably a length of the detected portion in the circumferential direction should be set to 0.1 to 6 mm, and more preferably this length should be set to 0.3 to 3 mm. A width of the slit is identical to a width of the guiding member.

It is preferable that this slit should be formed as a complete cut-off portion in the guiding member. The term "slit" does not means a recess portion that is provided in the continuous guiding member. It is preferable that the end portion of the guiding member should have a sectional shape that is cut vertically to the belt main body in the slit area. But the end portion may have a sectional shape that is inclined with respect to the belt main body. In this case, it is preferable that the end surface of the guiding member should have an angle of 45° or more but 90° or less to the belt main body.

It is preferable that, when the member as the detected portion is fixed in the slit of the guiding member, a thickness of this member should be set equal to or less than a thickness of the guiding member. More preferably a thickness of this member should be set smaller than a thickness of the guiding member. In particular, it is preferable that, in order to keep a non-contact condition to other members, the thickness should be 1/10 to 2/3 of a thickness of the guiding member. In this case, when the detected portion is fixed to the slit via the gluing agent and/or the adhesive agent, the thickness of the detected portion contains a thickness of the gluing agent and/or the adhesive agent. Also, when the detected portion is covered with a light transmissible resin, the thickness of the detected portion means a thickness that contains a thickness of this light transmissible resin.

<Detected Portion>

The detected portion can be provided in all locations of one slit or more in the guiding member.

When physical properties of the belt main body and the guiding member are different, the slit portion itself from which the belt main body is exposed can serve as the detected portion. By way of example, the case where a surface reflectance is different between the belt main body and the guiding member is shown.

Also, the member that has physical properties different from the guiding member may be fixed to the belt main body in the slit portion of the guiding member as the detected portion. When another member is fixed to the detected portion, a shape of this member is not particularly limited. A shape such as a circle, an ellipse, or the like as well as a shape such as a square, a rectangle, or the like can be chosen appropriately.

The physical property to be detected from the detected portion is not particularly limited, so long as the detecting sensor can detect such physical property. In the image forming apparatus belt of the present embodiment, preferably both end positions of the slit or the detected portion should be detected in a non-contact mode, and more preferably the detected portion should be detected optically. Also, it is preferable that the IC chip secured as the detected portion should be detected electronically in a non-contact mode.

In the present embodiment, as the mode in which the detected portion is detected by a laser beam, or the like in a non-contact mode, such a mode is contained that the detected portion is detected optically based on a difference in a reflectance or a difference in a refractive index.

As one mode of the image forming apparatus belt of the present embodiment, the case where a reflectance of the surface of the guiding member and a reflectance of the surface of the detected portion are different is listed. Concretely, the above case can be classified into the case where a reflectance of the surface of the guiding member is larger than a reflectance of the surface of the detected portion and the case where a reflectance of the surface of the guiding member is smaller than a reflectance of the surface of the detected portion. In both cases, a position of a boundary between the detected portion and the guiding member can be detected.

Two modes of the optical detected portion shown in FIGS. 2A and 28 will be explained hereunder.

By reference to FIG. 2A, for example, a carbon black is mixed in a belt main body 12, and the belt main body 12 shows a black color. Also, for example, a titanium white as a white pigment is mixed in a guiding member 13 that is adhered onto the inner surface of the belt main body 12, and the guiding member 13 shows a white color. Both end positions of a slit 14 in the guiding member 13 can be detected based on a difference in a reflectance in the position of the guiding member in the circumferential direction.

In FIG. 2B, for example, the carbon black is mixed in the belt main body 12, and the belt main body 12 shows a black color. Also, for example, the carbon black is mixed in a guiding member 15 that is adhered onto the inner surface of the belt main body 12, and the guiding member 15 shows a black color. A rectangular white board or a light reflecting member is fixed in the slit in the guiding member as a detected portion 17. Thus, a position of the detected portion can be detected optically when a reflectance is detected in the position of the guiding member in the circumferential direction.

It is preferable that a light reflecting member should be used as the detected portion provided to the slit in the guiding member. As the light reflecting member, a metal plate such as silver, gold, aluminum, or the like, a plate formed by depositing or laminating any one of these metals on a supporting body such as a plastic film, or the like, a plate formed by including metal powers of any one of these metals in a plastic film, and the like can be illustrated. Preferably the plastic plate on which the aluminum is deposited should be employed.

The light reflecting detected portion can be formed by fixing the above light reflecting member to the belt main body in the slit of the guiding member.

When the light reflecting member is used, the light reflecting member having a higher reflectance is preferable. It is preferable that the light reflecting member should have a light reflectance of 50% or more of the light used in the detecting portion. It is more preferable that the light reflecting member should have a light reflectance of 80% or more. A high detecting sensitivity can be achieved when the reflectance is within the above range.

A method of placing the detected portion in the slit of the guiding portion is set arbitrarily. The detected portion may be fixed to the belt main body via the gluing agent and/or the adhesive agent, and also the detected portion such as the metal plate, or the like may be fixed directly to the belt main body. When the detected portion is placed without the gluing agent and/or the adhesive agent, the peeling of the detected portion is hard to occur and durability can be improved. Therefore, this mode is preferable.

The detected portion may be fixed directly to the belt main body without intervention of the gluing agent and/or the adhesive agent.

In the image forming apparatus belt of the present invention, there is another preferred mode in which a refractive index of the guiding member is differentiated from a refractive index of the detected portion. Concretely, the above mode is classified roughly into the case where a refractive index of the guiding member is larger than a refractive index of the detected portion and the case where a refractive index of the guiding member is smaller than a refractive index of the detected portion. Also, it is preferable that the detected portion whose refractive index is larger than a refractive index of a transparent guiding member should be provided in the slit of this guiding member and this detected portion should be detected optically.

It is preferable that the detected portion should be covered with a protection layer. When the optical detecting method is employed, the detected portion can be covered with a protection layer made of a light transmissible resin. Thus, such an event can be prevented that scratches are made on the surface of the detected portion or a stain is adhered on the surface of the detected portion, and durability can be improved. Therefore, this mode is preferable.

As the material of the light transmissible resin, PET (polyethylene terephthalate), PP (polypropylene), polyimide, poly (vinyl chloride), polyamide, acrylic resin, transparent ceramic, and the like can be exemplified.

Also, as the method of coating a light transmissible resin, a spray coating method, a coating method, a method of pasting a tape made of the light transmissible resin, and the like can be listed by way of example. The method is not particularly limited.

A thickness of the protection layer made of the light transmissible resin can be chosen arbitrarily. But preferably the thickness should be set to 3 to 100 μm, and more preferably the thickness should be set to 10 to 50 μm.

<Belt Main Body>

As the material of the belt main body, a resin material whose Young's modulus is 2,000 MPa or more is preferably employed. When a synthetic resin material whose Young's modulus is 2,000 MPa or more is employed, a deformation caused by a stress applied from the outside is suppressed. The larger the Young's modulus becomes, the more the belt main body has a good property. The Young's modulus is set to 8,000 MPa or less in practical use, and preferably the Young's modulus should be set to 6,000 MPa or less. The Young's modulus of the belt main body can be controlled in the above range by selecting a chemical structure of the used synthetic resin material. The resin containing an aromatic ring structure has the higher Young's modulus.

In this case, the Young's modulus is derived by applying a tension test to the belt main body based on JIS K7127, then drawing a tangential line to touch a resultant stress-strain curve in an initial strain area, and then detecting a gradient.

As the material of the belt main body 12, polyimide resin, polyamideimide resin, polyester resin, polyamide resin, fluororesin, and the like are listed. Here, the belt main body may have the seam or not if such belt main body is formed like a loop. It is preferable that normally a thickness of the belt main body should be set to about 0.02 to 0.2 mm.

When the image forming apparatus belt of the present embodiment is used particularly as the intermediate transferring belt or the paper conveying belt, preferably a semi-conductive belt using a polyimide resin into which a conducting agent such as carbon black, or the like is added or a polyamideimide resin in which a conducting agent is also contained should be used as the belt main body. Here, the term "semi-conductivity" means that a surface resistivity and a volume resistivity described later has a particular numeric range given in the following.

The fabrication of the belt main body using a polyimide resin or a polyamideimide resin containing a conducting agent can be carried out by the publicly known method. For example, a polyamideimide solution containing a conducting agent is coated on an outer surface of a cylindrical body and then is dried and burned, and then a polyamideimide resin film is peeled off from the cylindrical body.

In case the belt of the present embodiment is used as the intermediate transferring belt or the paper conveying belt, it is preferable that a surface resistivity should be controlled in a range of $1\times10^{9}\Omega/\square$ to $1\times10^{14}\Omega/\square$ and also a volume resistivity should be controlled in a range of $1\times10^{8}$ Ωcm to $1\times10^{13}$ Ωcm. For this purpose, a conducting agent (conductive filler) can be added, as the case may be. As such conducting agent, carbon black such as a ketchen black, an acetylene black, or the like, metal or alloy such as a graphite, an aluminum, a nickel, a copper alloy, or the like, metallic oxide such as a tin oxide, a zinc oxide, a potassium titanate, a tin oxide-indium oxide, a composite oxide of tin oxide-antimony oxide, or the like, conductive polymer such as a polyaniline, a polypyrrole, a polysulfone, a polyacetylene, or the like, and others can be used preferably. These conductive fillers may be used solely or two types of the conductive fillers may be used in combination. Among them, the carbon black is preferable as the conductive filler from a viewpoint of cost. Also, a processing aid such as a dispersing agent, a lubricant, or the like can be added, as the case may be.

Here, a surface resistivity is measured in environments of 22° C. and 55% RH in compliance with JIS K6911 by using a Hi-Rester UPMCP-450 type UR probe manufactured by Dia Instrument Co., Ltd. A surface resistivity is measured at 24 points (3 locations in the width direction×8 locations in the circumferential direction) of the belt, and then an average value of them is regarded as a surface resistivity of the belt.

The belt main body must be formed of the flexible material as already described. A thermoplastic resin having elasticity or a synthetic rubber is preferably used. Also, from a viewpoint of durability of the belt main body, it is preferable that a polyimide resin or a polyamideimide resin, which is hard to deteriorate or alter, should be contained as a principal component.

By way of example of the manufacture of the belt main body, a coating solution that is obtained by adding a carbon black as a conducting agent into a solvent-soluble polyamideimide resin (Pyromax HR16NN manufactured by Toyobo Co., Ltd., or the like) or a polyimide resin (Euvarnish S manufactured by Ube Industries, Ltd., or the like) by 15 to 35 wt % per 100 wt % of a resin component and then dispersing admixtures into the resin is prepared, then the coating solution is coated on an outer surface of a metal mold, and then this coating solution is burned, whereby the belt main body made of a polyamideimide resin or a polyimide resin is manufactured. Then, a pair of blades which are aligned in predetermined width are stabbed into the resin in either a state that the belt main body is inserted into the cylindrical mold and wound thereon or a state that the belt main body is removed once from the forming pipe and then stretched on another two-axle roller, and then the belt main body is turned only by one rotation, whereby the belt main body having a predetermined width can be manufactured.

<Guiding Member>

In the present embodiment, a guiding member for preventing the wobbling motion is secured to the belt main body of the image forming apparatus belt.

When a pushing force for causing the belt main body to move in the roller shaft direction is generated after the belt main body is stretched on the roller, a reaction force (stress) produced against the pushing force to have the same strength is applied directly to the guiding member. From the viewpoint that the guiding member itself can scatter/absorb this stress to some extent, it is preferable that the guiding member should be formed of an elastic member whose durometer hardness is within a range of A60 to A90. Also, it is more preferable that the elastic member whose durometer hardness is within a range of A70 to A90 should be chosen. When a durometer hardness is set within the above range, neither the guiding member gets driven onto the supporting roller nor the belt main body follows up the belt supporting roller. A durometer hardness is measured at the portion of the guiding member, which has a thickness of 6 mm and has no slit, by using a type A durometer based on JIS K6253 (1997).

As the material of the elastic member having the above durometer hardness, an elastic body having an appropriate hardness such as polyurethane resin, neoprene rubber, polyurethane rubber, silicon rubber, polyester elastomer, chloroprene rubber, nitrile rubber, or the like, and others can be employed. Out of them, particularly a polyurethane rubber or a silicon rubber is preferably employed in view of electric insulation, moisture resistance, solvent resistance, ozone proof, thermal resistance, and wear resistance.

A sectional shape of the guiding member can be decided appropriately depending on the belt using conditions, etc. In order to get satisfactorily the wobbling motion preventing effect, preferably a sectional shape should be set substantially to a rectangular shape, and more preferably a sectional shape should be set to a rectangle. As already described, normally a width of the guiding member of 1 to 10 mm is preferable from viewpoints of wobbling motion preventing effect, durability, etc., and particularly a width of 4 to 7 mm is preferable. A thickness of the guiding member is not particularly limited. Normally a thickness of the guiding member of 0.5 to 5 mm is preferable from viewpoints of wobbling motion preventing effect, durability, etc., and particularly a thickness of 1 to 2 mm is preferable.

<Fabrication of an Image Forming Apparatus Belt>

A method of fabricating the belt of the present embodiment will be explained hereunder.

As described above, the fabrication of the belt main body can be carried out by the publicly known method. For example, a synthetic resin coating liquid in which a solvent, a solvent-soluble resin, and a conducting agent and others, if necessary, are mixed together is coated on an outer surface of a cylindrical body and then is dried and burned by heating, and then a resin film is peeled off from the cylindrical body.

A loop-shaped endless belt may be fabricated by adhering a sheet-like belt main body and a guiding member, and then adhering both end portions of the belt main body together. Otherwise, the endless belt may be fabricated by forming the belt main body like a loop shape, and then adhering the guiding member to the belt main body. The guiding member may be provided only along the side edge of the belt main body on one side. From further wobbling motion preventing effect, durability, reinforcing effect, etc., it is preferable that, in the case of the wide belt main body, the guiding member should be provided along the side edges on both sides. An adhered position of the guiding member onto the belt main body (distance from the side edge) can be set appropriately depending on a purpose and a function of the belt, a device to which the belt is fitted, and the like. The guiding member may be adhered along the end portion of the belt main body, or may be fixed to the position that enters appropriately to the center side of the belt main body from the end portion.

In FIG. 1, the belt 1 is constructed such that the guiding member 3 is adhered on an inside surface of the belt main body 2 and also the slit 4 is provided in the guiding member 3.

In order to adhere the guiding member to the belt main body, a heat-sensitive adhesive sheet containing an elastic adhesive agent can be used.

As shown in FIG. 2A, the slit 14 between the guiding members 13, 13 may be used as it is. Also, as shown in FIG. 2B, another detected portion 17 may be fixed to the slit between the guiding members 15, 15.

(Belt Stretching Device)

A belt stretching device of the present embodiment is characterized in that an image forming apparatus belt, and a plurality of rollers for stretching the image forming apparatus belt from the inside to support are provided. A groove for guiding the guiding member of the belt may be provided to each roller. Also, end surfaces of each roller on both sides may be formed as planes that are perpendicular to a center shaft respectively, and the guiding member may be restricted by outer peripheries of the end surfaces of the roller on both sides.

The belt stretching device of the present embodiment can be supported by a plurality of rollers in the image forming apparatus, described later, to circulate. The number of rollers is 2 or more, and preferably the number should be set to 2 to 4.

An outer peripheral surface of the image forming apparatus belt can function as a paper holding surface for holding a paper onto which a toner image is transferred, an intermediate transferring surface for transferring a toner image, a charging surface for charging a to-be-contacted member, a developer holding surface for holding a developer, and the like. The image forming apparatus belt has preferably the belt main body made of a synthetic resin, and can be used preferably in an electrophotographic copying machine, an exposure device for use in a laser printer, or the like, an intermediate transferring device, a transfer separating device, a paper conveying device, a charging device, a fixing device, a developing device, and the like. Here, material, shape, size, etc. of the belt main body can be set appropriately in answer to a purpose, a function, etc. of the belt.

(Image Forming Apparatus)

The image forming apparatus of the present embodiment is not particularly limited if such image forming apparatus can employ the belt of the present embodiment. This belt can be used in any purpose out of exposure, intermediate transfer, transfer separation, paper conveyance, charging, fixation, and development, for example. As modes of the image forming apparatus, the normal monochromatic color image forming apparatus in which only a monochrome toner is contained in the developing device, the color image forming apparatus in which toner images borne on the image bearing bodies such as photosensitive drums, or the like in respective colors are primarily transferred sequentially on the intermediate transferring belt in the same position, the tandem-type color image forming apparatus in which the image bearing bodies equipped with the developing devices in respective colors are aligned in series on the intermediate transferring body and a plurality of toner images are transferred on the same paper to superpose sequentially, and the like can be listed.

Figure 4:
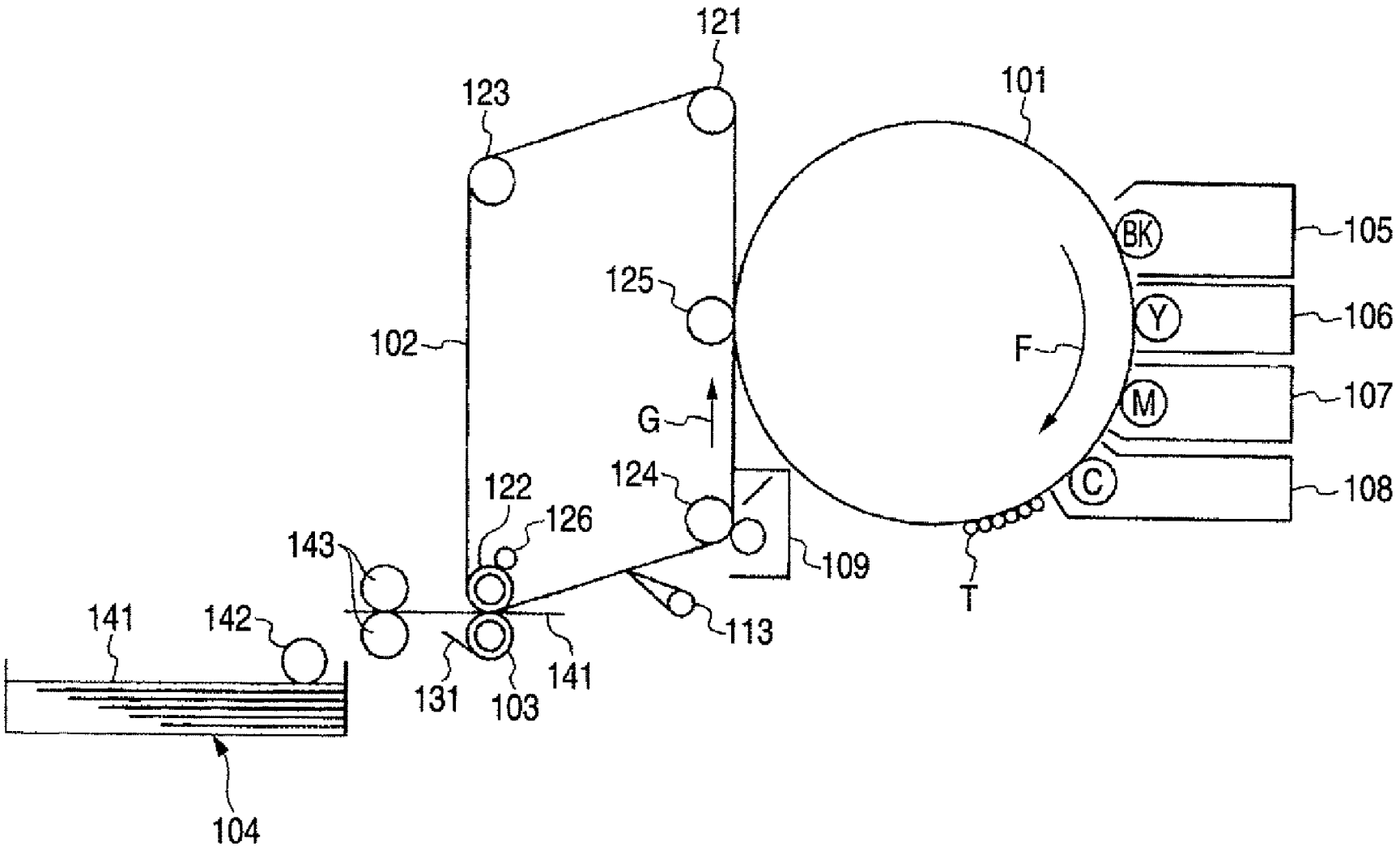
FIG. 4 is a schematic configurative view of an example of an image forming apparatus that is equipped with the image forming apparatus belt of the present embodiment as an intermediate transferring belt.

As an example of the image forming apparatus of the present embodiment, a color image forming apparatus for repeating the primary transfer is shown. FIG. 4 is a schematic view showing an image forming apparatus that is equipped with the image forming apparatus belt of the present embodiment as an intermediate transferring belt.

The image forming apparatus shown in FIG. 4 is constructed to include a photosensitive drum 101 as an image bearing body, an intermediate transferring belt 102 as an intermediate transferring body, a bias roller 103 as a transfer electrode, a tray 104 for feeding a paper as a transferred body, a developing unit 105 by a BK (black) toner, a developing unit 106 by a Y (yellow) toner, a developing unit 107 by a M (magenta) toner, a developing unit 108 by a C (cyan) toner, a belt cleaner 109, a separating claw 113, belt supporting rollers 121, 123, and 124, a backup roller 122, a conductive roller 125, an electrode roller 126, a cleaning blade 131, a paper 141, a pickup roller 142, and a field roller 143. The belt of the present embodiment is employed as the intermediate transferring belt 102.

The guiding members provided on the inside surface of the intermediate transferring belt 102 are positioned to come into contact with side edge portions of the belt supporting rollers 121, 123, and 124. Therefore, the intermediate transferring belt 102 is guided by the guiding members during the belt running, so that the intermediate transferring belt 102 never causes the wobbling motion during the belt running.

In the image forming apparatus shown in FIG. 4, a charged photosensitive drum 101 is rotated in the direction indicated with an arrow F, and its surface is charged uniformly by a charging unit (not shown). An electrostatic latent image in first color (e.g., BK) is formed on the charged photosensitive drum 101 by an image writing unit such as a laser writing unit. The electrostatic latent image is developed by the developing unit 105 using the toner, and a toner image T that is rendered visible is formed. The toner image T goes to the primary transferring portion, in which the conductive roller 125 is arranged, along with the rotation of the photosensitive drum 101. While causing the intermediate transferring belt 102 to attract electrostatically the toner image T by applying an electric field of opposite polarities to the toner image T from the conductive roller 125, the toner image T is primarily transferred onto the intermediate transferring belt 102 along with its rotation in the direction indicated by an arrow G. The conductive roller 125 may be arranged just below the photosensitive drum 101, as shown in FIG. 4, or may be arranged in the position that is displaced from an underlying area of the photosensitive drum 101.

Similarly, a toner image in second color, a toner image in third color, and a toner image in fourth color are formed sequentially. Then, respective toner images are superposed in the same position of the intermediate transferring belt 102 while detecting the detected portion provided to the belt by the detecting portion illustrated in FIG. 3. Thus, multiple toner images are formed. At this time, either a mono component toner or a dual component toner may be employed.

In order to superpose multiple toner images in the same position of the intermediate transferring belt 102, the detected portion such as an aluminum reflecting plate arranged in the slit in the guiding member on the intermediate transferring belt, or the like can be detected optically as a reference mark. As shown in FIG. 3, a detecting unit in which a light emitting element as a light emitting unit 33 and a light receiving element as a light receiving unit 35 are used in combination can be provided to an optical detecting portion 30 perpendicularly to the circumferential direction of the belt.

When the belt main body or the guiding member in which the carbon black is mixed is combined with the light reflecting member, a quantity of reflected light is increased abruptly on a surface of the detected portion to increase stepwise a detected voltage of the light receiving element. Then, when the optical detecting portion 30 returns to the belt main body or the guiding member, a quantity of reflected light is decreased abruptly to decrease stepwise the detected voltage of the light receiving element.

A voltage change responding to a quantity of reflected light is output to a controlling portion (not shown). When the position of the intermediate transferring belt is detected in synchronism with a detecting timing of this detected portion, the multiple toner images can be aligned precisely.

The multiple toner images transferred onto the intermediate transferring belt 102 reaches a secondary transferring portion, in which the bias roller 103 is provided, along with the rotation of the intermediate transferring belt 102. The secondary transferring portion is constructed by the bias roller 103 provided on the surface side on which the toner image of the intermediate transferring belt 102 is borne, the backup roller 122 provided on the back side of the intermediate transferring belt 102 to oppose to the bias roller 103, and the electrode roller 126 rotated while being press-contacted to the backup roller 122.

The paper 141 is picked up from a batch of papers contained in the tray 104 by the pickup roller 142 one sheet by one sheet. Then, the paper 141 is fed into a space between the intermediate transferring belt 102 and the bias roller 103 in the secondary transferring portion by the field roller 143 at a predetermined timing. Then, the toner image borne on the intermediate transferring belt 102 is transferred onto the fed paper 141 via the press-conveyance between the bias roller 103 and the backup roller 122 and the rotation of the intermediate transferring belt 102.

The paper on which the toner image is transferred is separated from the intermediate transferring belt 102 by operating the separating claw 113 that is positioned in a standby position until the primary transfer of the last toner image is ended, and then is conveyed to the fixing unit (not shown). Then, the toner image is fixed by the pressurizing/heating process, whereby a permanent image is formed. In this case, a residual toner is removed from the intermediate transferring belt 102, from which the transfer of the multiple toner images onto the paper is ended, by the belt cleaner 109 that is provided in a downstream of the secondary transferring portion. Then, the intermediate transferring belt 102 is prepared for the next transfer. Also, the bias roller 103 is fitted such that the cleaning blade 131 made of polyurethane, or the like always comes into contact with this bias roller. Foreign substances such as toner particles adhered in the transferring operation, paper fragments, etc. are removed by the cleaning blade.

In the case of transfer of the monochromatic image, the toner image T being primarily transferred is secondarily transferred directly and then the paper 141 is conveyed to the fixing unit. In contrast, in the case of transfer of the multicolor image obtained by superposing plural colors, the operations of the intermediate transferring belt 102 and the photosensitive drum 101 are synchronized with each other such that the toner images in respective colors coincide precisely mutually in the primary transferring portion, so that the toner images in respective colors are not displaced. In the secondary transferring portion, a voltage of the same polarity as the toner images (transfer voltage) is applied to the electrode roller 126 that is press-contacted to the backup roller 122. Thus, the toner images are transferred onto the paper by electrostatic repulsion. Here, this backup roller 122 is arranged to oppose to the bias roller 103 via the intermediate transferring belt 102.

With the above, the monochromatic or multicolor image can be formed.

Figure 5:
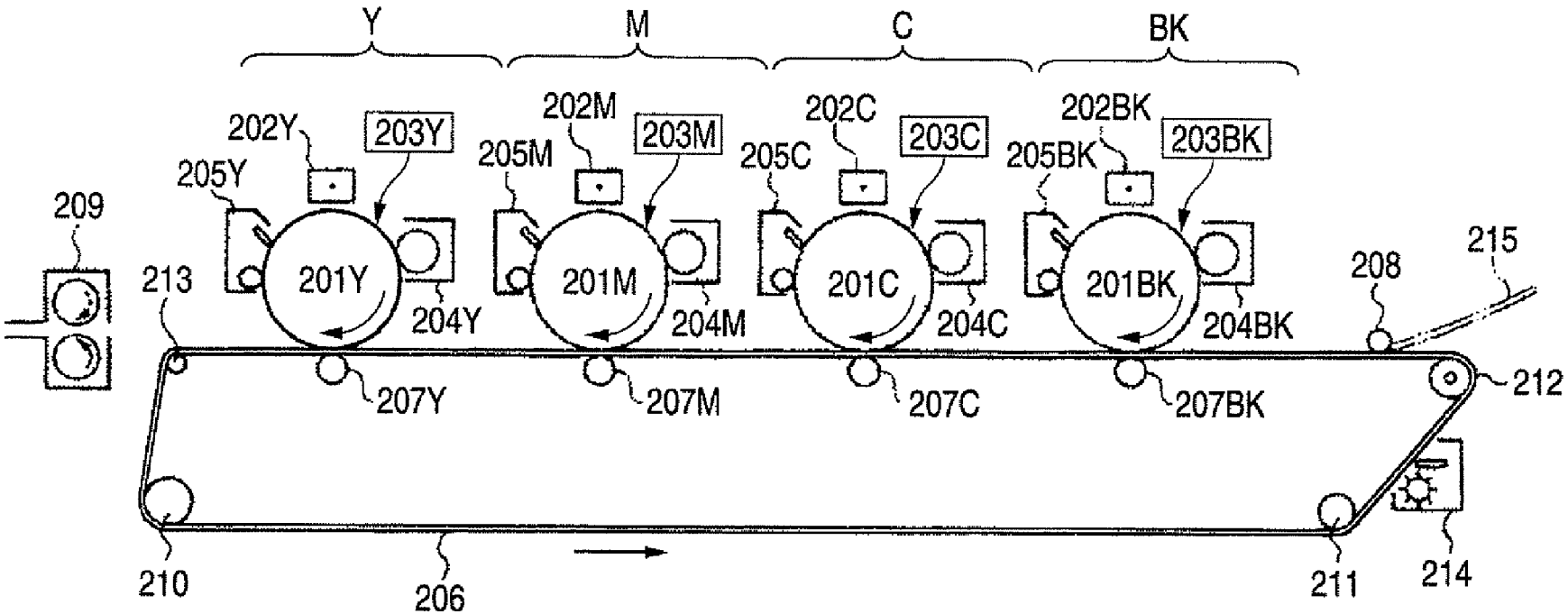
FIG. 5 is a schematic configurative view of an example of an image forming apparatus that is equipped with the image forming apparatus belt of the present embodiment as a paper conveying belt.

Next, another example of the image forming apparatus of the present embodiment is shown hereunder. FIG. 5 is a schematic view showing an image forming apparatus that is equipped with the image forming apparatus belt of the present embodiment as the paper conveying belt.

The image forming apparatus shown in FIG. 5 includes units Y, M, C, BK, a paper conveying belt 206, transferring rollers 207Y, 207M, 207C, 207BK, a paper conveying roller 208, and a fixing unit 209. The belt of the present embodiment is used as the paper conveying belt 206.

A guiding member (not shown) provided on the inner peripheral side of the paper conveying belt 206 is positioned to contact side edge portions of belt supporting rollers 210, 211, 212, 213. Therefore, the paper conveying belt 206 is guided by the guiding member during the belt running. Because the guiding member runs while fitting in guiding grooves formed in the belt supporting rollers 210, etc., the paper conveying belt 206 does not cause the problem of the wobbling motion during the belt running.

The units Y, M, C, BK are equipped with photosensitive drums 201Y, 201M, 201C, 201BK, which can rotate at a predetermined circumferential velocity (process speed) in a clockwise direction indicated with an arrow, respectively. Then, charging rollers 202Y, 202M, 202C, 202BK, exposure units 203Y, 203M, 203C, 203BK, respective color developing units (yellow developing unit 204Y, magenta developing unit 204M, cyan developing unit 204C, black developing unit 204BK), and photosensitive drum cleaners 205Y, 205M, 205C, 205BK are arranged around the photosensitive drums 201Y, 201M, 201C, 201BK respectively.

Four units Y, M, C, BK are aligned in parallel with the paper conveying belt 206 in order of units BK, C, M, Y. In this case, alignment order, etc. of the units Y, M, C, BK can be set appropriately to meet the image forming method.

The paper conveying belt 206 can be rotated in a counterclockwise direction indicated with an arrow by the belt supporting rollers 210, 211, 212, 213 at the same circumferential velocity as the photosensitive drums 201Y, 201M, 201C, 201BK. The paper conveying belt 206 is arranged such that a part of this belt positioned between the belt supporting rollers 212 and 213 contact the photosensitive drums 201Y, 201M, 201C, 201BK respectively. A belt cleaning unit 214 is provided to the paper conveying belt 206.

Figure 6:
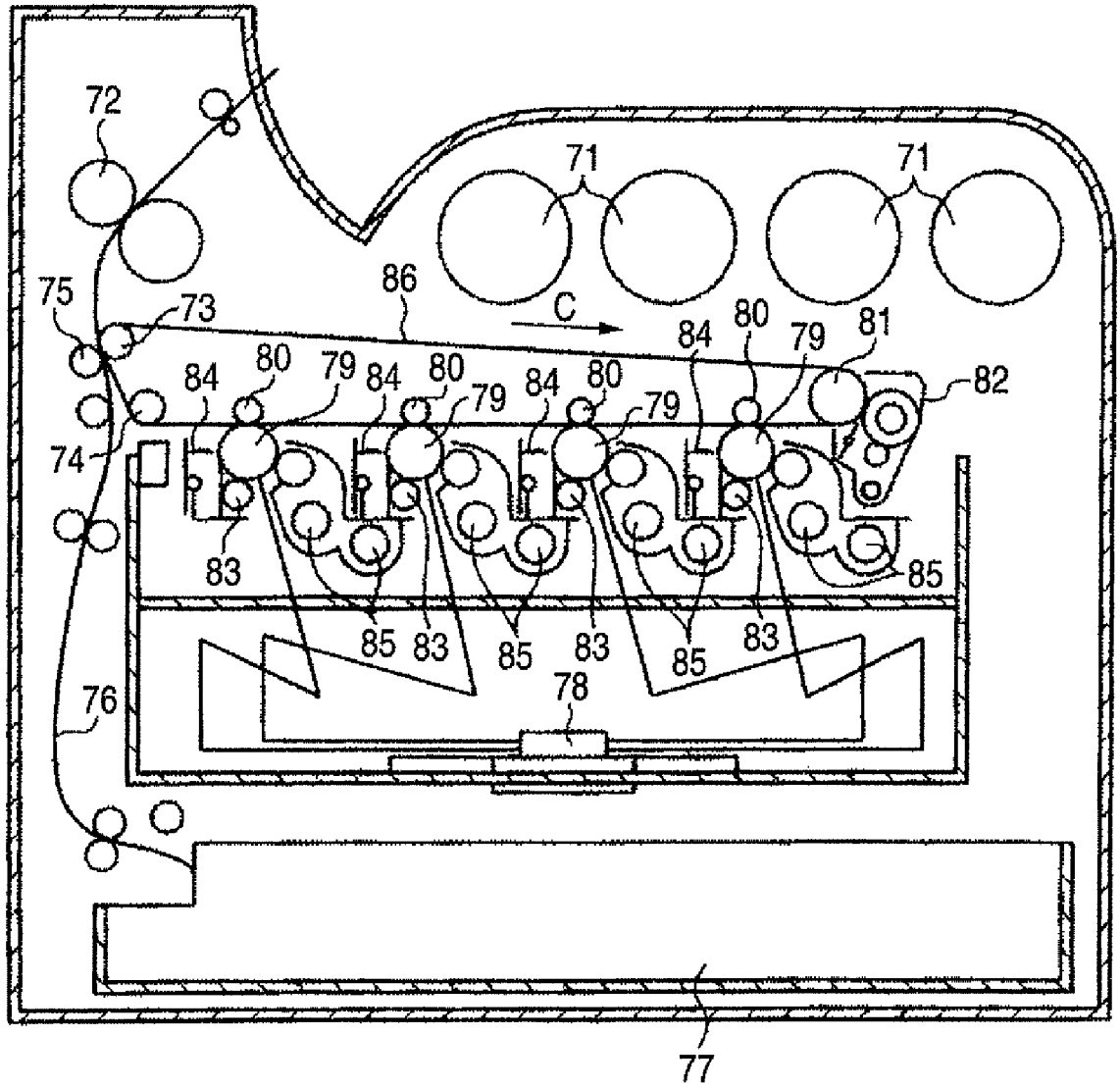

The transferring rollers 207Y, 207M, 207C, 207BK are arranged in positions that is located on the inside of the paper conveying belt 206 and face to portions where the paper conveying belt 206 contacts the photosensitive drums 201Y, 201M, 201C, 201BK respectively. The transferring rollers 207Y, 207M, 207C, 207BK and the photosensitive drums 201Y, 201M, 201C, 201BK constitute a transferring area (nip area), in which the toner image is transferred onto a paper (transferred body) 216 via the paper conveying belt 206, respectively. The transferring rollers 207Y, 207M, 207C, 207BK may be arranged just under the photosensitive drums 201Y, 201M, 201C, 201BK, as shown in FIG. 6, or may be arranged in displaced positions from their underlying areas.

The fixing unit 209 is arranged such that the paper 216 can be conveyed to this fixing unit after the paper passes through respective transferring areas (nip areas) between the paper conveying belt 206 and the photosensitive drums 201Y, 201M, 201C, 201BK.

A paper 216 is conveyed to the paper conveying belt 206 by the paper conveying roller 208.

In the image forming apparatus shown in FIG. 5, the photosensitive drum 201BK is rotated/driven in the unit BK. The charging roller 202BK is driven in synchronization with this drum, and charges uniformly a surface of the photosensitive drum 201BK in predetermined polarity and electric potential. Then, the photosensitive drum 201BK whose surface is charged uniformly is exposed by the exposure unit 203BK to give an image, and an electrostatic latent image is formed on the surface.

Then, the electrostatic latent image is developed by the black developing unit 204BK. Here, the toner image is formed on the surface of the photosensitive drum 201BK. At this time, either a mono component toner or a dual component toner may be employed.

The toner image passes through the transferring area (nip area) between the photosensitive drum 201BK and the paper conveying belt 206, and simultaneously the paper 216 is attracted electrostatically to the paper conveying belt 206 and conveyed to the transferring area (nip area). Then, the toner image is transferred onto the surface of the paper 216 sequentially by an electric field that is formed by a transfer bias being applied by the transferring roller 207BK.

Then, the toner remaining on the photosensitive drum 201BK is cleaned/removed by the photosensitive drum cleaner 205BK. Then, the photosensitive drum 201BK is prepared for the next transferring cycle.

The above transferring cycle is carried out similarly in the units C, M, and Y. At this time, the toner images formed by respective units are superposed on the same paper in sequence. Here, because the detected portion that is secured to the slit in the guiding member fixed to the paper conveying belt 206 is detected optically, the position control of the paper that is passed through the transferring portions of respective units and is attracted to the conveying belt can be executed.

The paper 216 on which the toner image is transferred by the transferring rollers 207Y, 207M, 207C, 207BK respectively is conveyed further to the fixing unit 209, and the image is fixed there.

With the above, a desired image is formed on the paper.

Further, still another example of the image forming apparatus of the present embodiment is shown hereunder. FIG. 6 is a schematic view explaining major portions of a tandem-type image forming apparatus that is equipped with the image forming apparatus belt of the present embodiment as the intermediate transferring belt.

Concretely, charging rollers (charging units) 83 for charging uniformly surfaces of photosensitive bodies 79 respectively, a laser oscillator (exposure unit) 78 for exposing the surfaces of the photosensitive bodies 79 to form the electrostatic latent image respectively, developer units (developing units) 85 for developing the latent images formed on the photosensitive bodies 79 by using a developer to form the toner image respectively, primary transferring rollers 80 for transferring the developed toner images onto an intermediate transferring belt 86 respectively, photosensitive body cleaners (cleaning units) 84 for removing the toner, the dust, etc. stuck to the photosensitive bodies 79 respectively, a pair of fixing rollers 72 for fixing the toner images on the transferred member, and the like can be provided arbitrarily in the publicly known manner, as the case may be. Here, the primary transferring rollers 80 may be arranged just over the photosensitive bodies 79, as shown in FIG. 6, or may be displaced from the positions just over the photosensitive bodies respectively. Because the belt of the present embodiment is provided as the intermediate transferring belt 86, a high transferred picture quality can be obtained stably even in the tandem-type image forming apparatus constructed as above.

Further, a configuration of the image forming apparatus shown in FIG. 6 will be explained hereunder. The image forming apparatus shown in FIG. 6 is constructed to include four toner cartridges 71, a pair of fixing rollers 72, a backup roller 73, a tension roller 74, a secondary transferring roller 75, a paper conveying path 76, a paper tray 77, the laser oscillator 78, four photosensitive bodies 79, four primary transferring rollers 80, a driving roller 81, a transfer cleaner 82, four charging rollers 83, the photosensitive body cleaners 84, the developer units 85, the intermediate transferring belt 86, and the like as major constituent members.

First, the charging roller 83, the developer unit 85, the primary transferring roller 80 arranged via the intermediate transferring belt 86, and the photosensitive body cleaner 84 are provided in a counterclockwise around the photosensitive body 79. A set of these members constitutes the developing unit to correspond to each color. Also, the toner cartridge 71 for supplementing the developer to the developer unit 85 is provided every developing unit respectively. The laser oscillator 78 capable of irradiating a laser light onto the surface of the photosensitive body 79 between the charging roller 83 and the developer unit 85 in respective developing units in response to the image information is provided.

Four developing units corresponding to four colors (e.g., cyan, magenta, yellow, black) are arranged in series in the substantially horizontal direction in the image forming apparatus. The intermediate transferring belt 86 is provided to pass through the nip portions between the photosensitive bodies 79 and the primary transferring rollers 80 in four developing units. The intermediate transferring belt 86 is stretched on the backup roller 73, the tension roller 74, and the driving roller 81, which are counterclockwise provided on the inner peripheral side of this belt in this order. In this case, four primary transferring rollers 80 are positioned between the backup roller 73 and the tension roller 74. Also, the transfer cleaner 82 for cleaning the outer peripheral surface of the intermediate transferring belt 86 is provided on the opposite side to the driving roller 81 via the intermediate transferring belt 86 to press-contact the driving roller 81.

Also, the secondary transferring roller 75 is provided on the opposite side to the backup roller 73 via the intermediate transferring belt 86 to press-contact the backup roller 73. This secondary transferring roller 75 transfers the toner image, which is formed on the outer peripheral surface of the intermediate transferring belt 86, on a surface of the recording paper that is conveyed from the paper tray 77 via the paper conveying path 76.

Also, the paper tray 77 for stocking the recording paper is provided to the bottom portion of the image forming apparatus. The paper can be fed through the paper conveying path 76 from the paper tray 77 to pass through the press contacting portion between the backup roller 73 and the secondary transferring roller 75 constituting the secondary transferring portion. The recording paper after passed through the press contacting portion can be further fed by the conveying unit (not shown) to pass through the press contacting portion between a pair of fixing rollers 72. Finally, the recording paper can be discharged to the outside of the image forming apparatus.

Next, an image forming method using the image forming apparatus in FIG. 6 will be explained hereunder. The formation of the toner image is carried out every developing unit in such a way that the surface of the photosensitive body 79 rotated in the counterclockwise direction is charged uniformly by the charging roller 83, then the latent image is formed on the charged surface of the photosensitive body 79 by the laser oscillator (exposure unit) 78, then the toner image is formed by developing the latent image by the developer that is supplied from the developer unit 85, then the toner image is conveyed to the press contacting portion between the primary transferring roller 80 and the photosensitive body 79, and then the toner image is transferred onto the outer peripheral surface of the intermediate transferring belt 86 that is rotated in the direction indicated with an arrow C. After the toner image is transferred, the toner, the dust, etc. stuck on the surface of the photosensitive body 79 are cleaned by the photosensitive body cleaner 84. Then, the photosensitive body 79 is prepared for the next formation of the toner image.

The toner images developed by every developing unit in each color are transferred onto the surface of the recording paper, which is conveyed from the paper tray 77 through the paper conveying path 76, by the secondary transferring roller 75 of the secondary transferring portion in a state that these toner images are superpose sequentially on the outer peripheral surface of the intermediate transferring belt 86 to correspond to the image information. In order to superpose sequentially respective color toner images on the same recording paper, the same paper is caused to go to and from the press-contacting portion between the backup roller 73 and the secondary transferring roller 75. The control of the belt position is made by detecting the detected portion provided on the guiding member.

Then, the recording paper on which respective color toner images are transferred is pressurized/heated when it passes through the press-contacting portion between a pair of fixing rollers 72 constituting the fixing unit. Thus, respective color toner images are fixed, and the image is formed on the surface of the recording medium. Then, the recording paper is discharged to the outside of the image forming apparatus.

EXAMPLES

The present embodiment will be explained more concretely with reference to Examples hereunder. But the present embodiment is not limited to respective modes in these examples.

(Fabrication of the Belt Main Body)

An N-methyl-2-pyrrolidone (NMP) solution (a solid content rate is 18 wt % after imide inversion) of a polyamic acid consisting of 3,3',4,4'-biphenyl tetracarboxylate bianhydride and 4,4'-diaminodiphernyl ether is prepared. A carbon black (Special Black 4: manufactured by Degussa Corporation) is added to this NMP solution at a rate of carbon black 80 wt % to polyamic acid solid content 100 wt %. A resultant solution is passed through a dispersing unit 5 times at a pressure 200 MPa by using a jet-mill dispersing machine (Geanus PY [a minimum cross section of a collision portion is 0.032 $mm^2$]: manufactured by Geanus Corporation) to execute the dispersion/mixture. Thus, a dispersion liquid (A) is obtained.

The NMP solution (a solid content rate is 18 wt % after imide inversion) of the polyamic acid consisting of 3,3',4,4'-biphenyl tetracarboxylate bianhydride and 4,4'-diaminodiphernyl ether is added to the resultant dispersion liquid (A) at a rate of carbon black 27.8 wt % to polyamic acid 100 wt %. A resultant solution is mixed/stirred by using a planetary type mixer (Aiko Mixer: manufactured by Aikosya Manufacturing Co., Ltd.). Thus, a polyimide precusor solution into which the carbon black is dispersed is prepared.

Then, a cylindrical base material formed of a cylindrical aluminum, on which a mold release agent is baked previously and which has an outer diameter of 366 mm, a length of 600 mm, and a thickness of 6 mm, is prepared as a core body in molding. Then, the core body is rotated at 100 rpm. Then, while moving a dispenser and a scraper at a speed of 150 min/min on the outer peripheral surface of the core body, the polyimide precusor solution is coated to have a coated length of 400 mm and a thickness of 0.5 mm. The polyimide precusor solution is heated/dried at 140° C. for 30 minutes while rotating the core body at 5 rpm, and then cooled down to an ordinary temperature. Then, the polyimide precusor solution is heated at 200° C. for 30 minutes, 260° C. for 30 minutes, 300° C. for 30 minutes, and 320° C. for 20 minutes. Thus, a polyimide film into which the carbon black is dispersed is formed. Then, when a temperature of the cylindrical molding pipe is cooled down to a room temperature (25° C.), the polyimide film is released from the cylindrical molding pipe. The resultant polyimide film is cut in 369 mm width, and thus the belt main body 2 having an outer diameter of 366 mm and a thickness of 80 μm is obtained.

(Fabrication of Guiding Member A)

As a guiding member A, a transparent thermosetting polyurethane sheet whose JIS hardness is 70 degree (Tiplane TR-100-70: manufactured by Tigers Polymer Corporation) is cut into thin rectangles. A sectional shape has a thickness of 2.0 mm and a width of 3.0 mm.

(Fabrication of Guiding Member B)

Also, a thermosetting polyurethane sheet into which a titanium white is kneaded separately as a white pigment is fabricated. This thermosetting polyurethane sheet is cut into thin rectangles.

(Fabrication of Guiding Member C)

Also, a thermosetting polyurethane sheet into which a carbon black is mixed separately as a black pigment is fabricated. This thermosetting polyurethane sheet is cut into thin rectangles.

(Adhesion of the Guiding Member to the Belt Main Body and Formation of the Slit)

As the elastic adhesive, Super X No. 8008 containing an acryl denatured silicone polymer manufactured by Cemedine Co., Ltd. as a principle component is coated on the guiding member up to a thickness of 20 μm. Then, the guiding member is arranged on the inner side surface of the belt main body 2 made of the polyamideimide resin along the side edge on one side, and then pressurized by a pressure of 0.03 MPa. Thus, the belt having the guiding member in which the rectangular slit shown in FIG. 1 is provided is fabricated. A length of the slit in the circumferential direction is 2.0 mm.

(Fabrication of the Light Reflecting Member)

<Light Reflecting Member A>

As a light reflecting member A, a 50 mm square sheet having a total thickness of 5 μm is formed by depositing aluminum on one surface of a PET film and coating a silicon gluing agent on the other surface of the PET film. The detected portion whose width is 3.0 mm and whose length is 2.0 mm is cut out from this light reflecting member A.

(Evaluation)

The image forming apparatus belt in which the detected member is provided in the slit of the guiding member being fixed to the belt main body is tested by the converted machine of Docu Centre-II C6500 manufactured by Fuji Xerox Co., Ltd. Then, the soil or wear of the detected member is visually checked. In this case, an initial detecting voltage of the detected portion is set to 4.5 V. After a time elapsed test, the voltage of 3.0 V or more is decided good and the voltage of 4.0 V or more is decided better. Also, the test is made up to the longest 500 K ($500\times10^3$) cycles, where one rotation of the belt is regarded one cycle.

Example 1

Fabrication of a Belt A

An image forming apparatus belt A is fabricated by adhering the white guiding member B on the inside surface of the loop-shaped belt main body 2 along the side edge on one side. As shown in a fragmental enlarged view in FIG. 2A, the belt main body 12 is exposed in black from the slit 14 with a length of 2 mm.

Example 2

Fabrication of a Belt B

An image forming apparatus belt B is fabricated by adhering the black guiding member C on the inside surface of the belt main body 2 along the side edge on one side. The light reflecting member A is pasted on the slit. As shown in a fragmental enlarged view in FIG. 2B, the light reflecting member 17 is fixed in the slit with a length of 2 mm. In this case, first the light reflecting member A may be pasted on the inside surface of the belt main body 12, and then the guiding member may be adhered.

Example 3

Fabrication of a Belt C

An image forming apparatus belt C is fabricated by adhering the transparent guiding member A on the inside surface of the belt main body 2 along the side edge on one side. The light reflecting member A is pasted on the slit. As shown in a fragmental enlarged view in FIG. 2B, the light reflecting member 17 is fixed in the slit with a length of 2 mm.

<Evaluated Result>

After the image forming apparatus belts A, B and C are evaluated up to 500 K cycles, the wear or soil on the detected portion is not detected from all belts. These belts cause no problem in the belt running, and the detected voltage of the detecting portion is 4.45 V and is good.

Comparative Example 1

Fabrication of a Comparative Belt A

A comparative belt A is manufactured totally similarly to the image forming apparatus belt A except that the slit is not provided in the guiding member. One light reflecting member A is pasted onto one peripheral edge portion on the outer peripheral surface of the belt main body.

Comparative Example 2

Fabrication of a Comparative Belt B

The light reflecting member A is pasted onto on the inner side surface of the belt main body than the image forming apparatus belt obtained in the comparative belt A, which is closer to the center side than the guiding member.

Comparative Example 3

Fabrication of a Comparative Belt C

A comparative belt C is manufactured totally similarly to the image forming apparatus belt obtained in the comparative belt A except that the slit is not provided in the guiding member. The light reflecting member A is pasted onto the surface of the guiding member of the resultant belt.

<Evaluated Result>

After the comparative belts A, B and C are tested similarly up to 500 K cycles, the results are evaluated. In the comparative belt A, the wear and the soil are found. Also, in both the comparative belt B and the comparative belt C, the wear and the soil are found.

What is claimed is:

1. An image forming apparatus belt comprising:

a belt main body;

a guiding member that is fixed to the belt main body along at least a side edge on one side of the belt main body, wherein the guiding member defines a slit formed as a complete cut-off portion in the guiding member; and a detected portion for position detection that is provided in the slit of the guiding member, the detected portion being detected based on a position of the slit, wherein the belt main body contains a carbon black, and the guiding member contains a titanium white.

2. The image forming apparatus belt according to claim 1, wherein a reflectance of a surface of the guiding member differs from a reflectance of a surface of the detected portion.

3. The image forming apparatus belt according to claim 2, wherein the reflectance of the surface of the guiding member is larger than the reflectance of the surface of the detected portion.

4. The image forming apparatus belt according to claim 2, wherein the reflectance of the surface of the guiding member is smaller than the reflectance of the surface of the detected part.

5. The image forming apparatus belt according to claim 1, wherein the slit itself is the detected portion for position detection.

6. The image forming apparatus belt according to claim 1, comprising:

a member in the slit as the detected portion.

7. The image forming apparatus belt according to claim 6, wherein the member as the detected portion has a thickness of equivalent to or smaller than a thickness of the guiding member.

8. The image forming apparatus belt according to claim 6, wherein the member as the detected portion has a thickness of smaller than a thickness of the guiding member.

9. The image forming apparatus belt according to claim 6, wherein the guiding member contains a carbon black, and the member as the detected portion is a rectangular white plate or a light-reflecting member.

10. The image forming apparatus belt according to claim 9, wherein the light-reflecting member is selected from the group consisting of:

(A) a metallic plate made of silver, gold or aluminum;

(B) a plate comprising a plastic film; and silver, gold or aluminum, which is vapor-deposited or laminated on the plastic film, and (C) a plate comprising a plastic film containing a metal powder made of silver, gold or aluminum.

11. The image forming apparatus belt according to claim 1, wherein the slit is a part where the guiding member is completely cut off.

12. The image forming apparatus belt according to claim 1, further comprising:

a protection layer that covers the detected portion.

13. The image forming apparatus belt according to claim 12, wherein the protection layer contains one kind selected from the group consisting of PET (polyethylene terephthalate), PP (polypropylene), polyimide, polyvinyl dichloride, polyamide, acrylic resin, and transparent ceramic.

14. A belt stretching device comprising:

the image forming apparatus belt according to claim 1; and a plurality of rolls that stretch and support the image forming apparatus belt from inside.

15. An image forming apparatus comprising:

the image forming apparatus belt according to claim 1.

* * * * *